US006196337B1

(12) United States Patent
Sikes

(10) Patent No.: US 6,196,337 B1
(45) Date of Patent: Mar. 6, 2001

(54) WATER PRESSURE POST-HOLE DIGGER

(76) Inventor: Jared A. Sikes, 115 Howard Flats Rd., Chelan, WA (US) 98116

( * ) Notice: Subject to any disclaimer, the term of this patent is extended or adjusted under 35 U.S.C. 154(b) by 0 days.

(21) Appl. No.: 09/300,707

(22) Filed: Apr. 27, 1999

Related U.S. Application Data

(60) Provisional application No. 60/083,225, filed on Apr. 27, 1998.

(51) Int. Cl.[7] ..... E21B 7/18; E21B 21/00

(52) U.S. Cl. ..... 175/211; 175/67

(58) Field of Search ..... 175/322, 323, 175/424, 211, 209, 67; 405/248; 299/17

(56) References Cited

U.S. PATENT DOCUMENTS

| | | | | |
|---|---|---|---|---|
| 3,638,741 | | 2/1972 | Zizak | 175/215 |
| 3,887,021 | * | 6/1975 | Elbert | 175/422 |
| 4,919,204 | * | 4/1990 | Baker et al. | 166/223 |
| 4,921,375 | * | 5/1990 | Famulari | 408/67 |
| 4,986,373 | | 1/1991 | Charland et al. | 175/21 |
| 5,029,651 | | 7/1991 | Ubbink | 175/19 |
| 5,361,885 | * | 11/1994 | Schuermann et al. | 175/67 |

FOREIGN PATENT DOCUMENTS 2406699 10/1977 (FR) .

* cited by examiner

*Primary Examiner*—David Bagnell
*Assistant Examiner*—Jennifer M Hawkins
(74) *Attorney, Agent, or Firm*—Todd N. Hathaway

(57) ABSTRACT

A water pressure operated post-hole digging tool. The tool includes a vertically elongate pipe with an enlarged mandrel member having a generally circular cross section mounted on its lower end, and an attachment for connecting the upper end of the conduit to a source of water pressure. The water pressure is discharged through an open end at the bottom of the mandrel member, so that soil is dislodged at the bottom of the post-hole bore. The flow of water then passes upwardly through the annular cavity around the sides of the mandrel member so as to scour out of the sides of the bore. The lower end of the mandrel member is tapered so as to accelerate the flow of water as this passes into the annular cavity around the body, and upper taper slows the flow as it exits the cavity and flows up the excavated bore. The mandrel member may be formed of solid plastic material.

23 Claims, 4 Drawing Sheets

WATER PRESSURE POST-HOLE DIGGER

This application claims the benefit of U.S. Provisional Application No. 60/083,225, filed Apr. 27, 1998.

BACKGROUND OF THE INVENTION a. Field of the Invention

The present invention relates generally to apparatus for digging postholes and other small-diameter holes in the earth, and more particularly, to a hand-held posthole digger which forms bores in the earth by application of water pressure.

b. Related Art

Posthole diggers are used to bore comparatively small diameter holes in the earth, for installation of fence posts, and other posts and supports of various kinds. For purposes of convenience, the term "fence post", as used in this description will be understood to include all such supports and similar members, which are installed or otherwise placed so as to extend a few feet into the earth.

Although fence posts are, of course, widely used, they are particularly prevalent in the agricultural industries. For example, a typical livestock operation or orchard will have many hundreds or even thousands of fence posts, used for fences, to support trees or vines, and so on. Since the posts must be replaced or moved from time-to-time, the time and labor involved in installing fence posts becomes a major concern for many farmers, ranchers, orchardists, and so on.

Prior art posthole digging tools, however, have remained notoriously slow, labor-intensive, and inefficient in use. Manual posthole diggers have generally taken one of two forms: The most common comprises a pair of shovel-shaped blades which are joined together by a hinge, at the end of a pair of long poles; the operator thrusts the tool downwardly into the ground and then brings the blades together to withdraw a scoop of dirt. These tools are slow and tiring to use, and all the more inefficient due to their tendency to let dirt fall back into the hole as it is being withdrawn.

A second form of manual posthole digger uses a pair of auger like blades which define a bucket-like structure at the lower end of the tool, into which the dirt is scooped as the tool is rotated by the operator; after a few turns, the tool is lifted from the ground, dumped and the process is repeated. While superior in some respects to the type of tool described above, this latter form does not work well in rocky earth, and in any event remains an highly labor-intensive device.

Powered posthole diggers generally take the form of a long, screw-like auger mounted to a power head. Portable types are usually powered by a gasoline engine, and are comparatively fast in action. However, they are expensive, complicated, unreliable, and generally require two men in order to hold the power head against the torque which is generated by the bit during operation. These problems, especially the additional labor costs, represent serious drawbacks in commercial use.

Other types of posthole diggers are available which are designed to be mounted to a vehicle, such as a tractor or BOBCAT™ loader or similar vehicle for example. These devices are commonly driven using the vehicle's hydraulic system, and have the advantage of requiring only one operator. Again, however, they tend to be very expensive. Moreover, because they are mounted to the vehicle, this means that the vehicle must be maneuvered each time another hole is to be made, and in many instances there will not be enough room in which to maneuver the vehicle, as around trees or other obstacles. Once again, these drawbacks can present serious problems in a commercial operation, especially in the case of an orchard or a vineyard where many posts and other supports need to be placed in and amongst the plants themselves.

Accordingly, there exists a need for a posthole digger which is fast and efficient in operation, and which requires only a single operator, but which is also easily portable and convenient to use. Moreover, there exists a need for such a posthole digger which is simple and inexpensive in construction, and highly durable and reliable for extended use in a commercial operation.

SUMMARY OF THE INVENTION

The present invention has solved the problems cited above, and is a portable tool for formation of postholes and other bores by application of water pressure.

The tool includes a vertically elongate conduit having an enlarged mandrel member mounted on its lower end, and means for connecting the upper end of the conduit to a source of water pressure. The water pressure is discharged through an open end of the conduit at the bottom of the mandrel member, so that soil is dislodged and carried in the flow upwardly along the sides of the mandrel member, and then discharged out of the bore at the surface of the ground.

The mandrel member may be a vertically elongate, three-dimensional member which is generally circular in horizontal cross-section. The lower tip of the mandrel member may have a conical downward taper for penetrating into the ground, and for distributing the flow outwardly and upwardly over the body of the member. The body of the mandrel member may be generally cylindrical in form, and may have a diameter approximately equal to the diameter of the bore to be formed. The upper tip of the mandrel member may have an upward conical taper, over which the flow passes into the bore and to the surface.

The mandrel member may have a central bore through which the vertical pipe extends axially. The mandrel member may be detachably mounted to the pipe member so as to permit the mandrel member to be interchangeably removed and replaced with mandrel members of different sizes or shapes.

The tool may also include a valve for controlling the flow of water to the lower end thereof, and the control valve may be a manually operated ball valve. The tool may also include at least one transversely extending handle member for enabling the operator to exert a downward pressure on the tool.

The means for connecting the upper end of the vertical conduit to the source of water pressure may be a flexible hose for permitting the operator to manually maneuver and position the tool. The flexible hose may include a reinforced section where this is attached to the conduit.

The conduit may suitably be formed of pipe, such as galvanized steel pipe. The mandrel member may suitably be formed of dense plastic material.

DETAILED DESCRIPTION a. Overview

Figure 1:
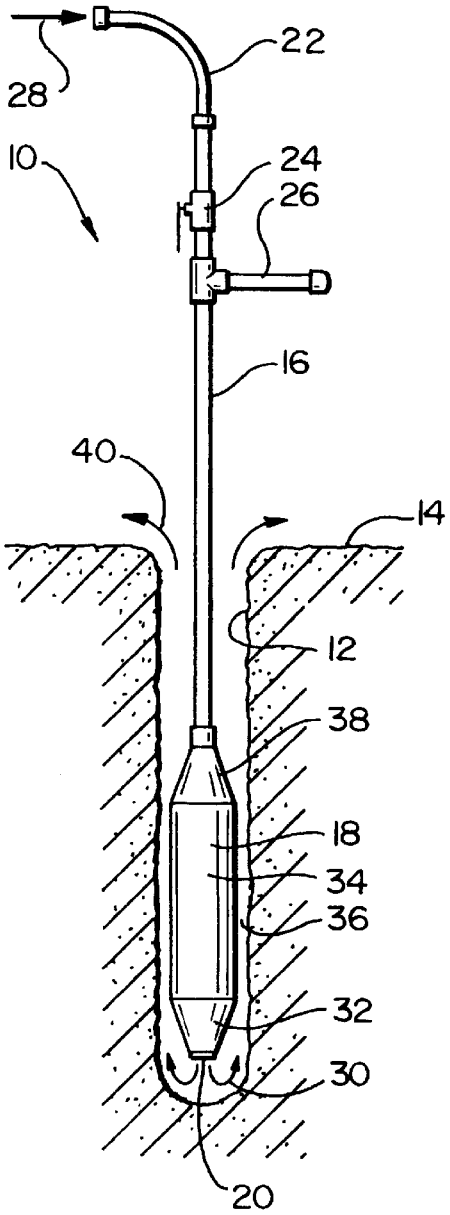
FIG. 1 is an elevational view of a posthole digging tool in accordance with the present invention, showing the manner in which the tool is used to bore a hole into the ground, the ground being shown cut away for purposes of illustration.

FIG. 1 shows a posthole digging tool 10 in accordance with the present invention, as this is being used to form a hole 12 in the ground 14.

As can be seen, the tool 10 includes an elongate, comparatively small-diameter primary pipe 16 which serves as the main shaft member of the assembly, with a mandrel member 18 being mounted on its lower end. The pipe extends through the mandrel member to an opening 20 at the lower end, and the upper end of the pipe, in turn, is connected to a supply of water pressure, via flexible hose segment 22. A ball valve 24 controls the flow of water through the pipe, and a handle 26 extends laterally from one side of the pipe to enable the operator to exert a downward pressure on the assembly.

In operation, water pressure is supplied to the assembly through the flexible hose segment 22, in the direction indicated by arrow 28. With valve 24 open, the water passes down the length of the main pipe 16, and is discharged through the opening 20 at the bottom of the mandrel member, as indicated by arrows 30 in FIG. 1. The comparatively high-pressure/high-velocity flow at the discharge opening breaks up and dislodges the soil in the area below the mandrel tip, fluidizing and suspending the material in the water.

The lower end of the mandrel member is provided with a conical taper 32 which helps the mandrel penetrate into the ground, and also directs the flow of water/mud (which has been deflected by the bottom of the hole) in an upward and outward direction, so that the flow passes upwardly and is distributed more or less evenly around the cylindrical main body 34 of the mandrel. This forces the flow into an annular channel 36, which scours the walls of the hole so as to form a more-or-less smooth-walled, constant-diameter bore; the relatively narrow, constricted annular passage increases the velocity of the flow in this area, thereby enhancing the scouring action. This also eliminates any need to twist or turn the tool in order to form a round, symmetrical bore.

The upper end of the mandrel is provided with an upward taper 38 so that the flow above the mandrel opens back into the bore, which slows the flow somewhat so as to reduce the amount of splashing/spray at the surface. The flow passes upwardly through the bore, carrying the mud and other suspended soil materials with it, and discharges out of the top of the hole over the surface of the ground, as indicated by arrows 40. Once the hole has reached the desired depth, the tool is removed and repositioned to form the next bore.

The tool of the present invention has proven capable of digging fence postholes very rapidly, in a matter of just a few minutes, using water pressures as low as 30–40 psi. This allows the tool to be used with comparatively low-pressure water systems, such as in some municipal and well water systems. Moreover, for commercial/agricultural applications, much higher water pressures can be used, e.g., on an order of 150 psi: For example, water pressure can be supplied to the tool from a PTO-driven sprayer pump on a tractor or other vehicle, making for very rapid formation of postholes. Unlike the conventional vehicle-mounted posthole diggers described above, however, the connection to the vehicle is via a flexible hose, so that the operator is free to move the tool about and into confined areas, such as amongst trees, vines, and so on.

Figure 2:
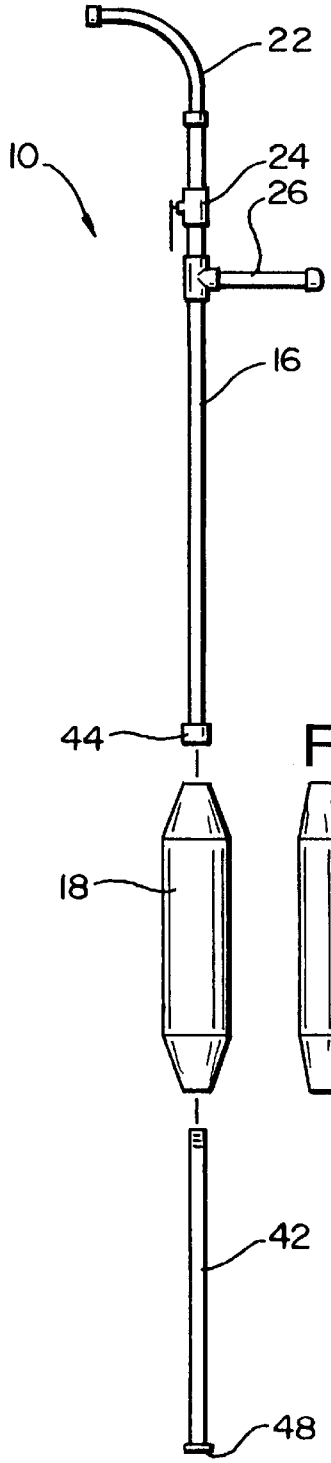
FIG. 2 is an exploded view of the hole digging tool of FIG. 1, with this being disassembled to show the manner in which mandrel members of different sizes/shapes are interchangeably mountable on the lower end of the tool.
Figure 2A:
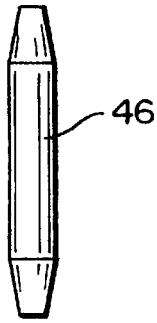
FIG. 2A is an elevational view of a mandrel member having a different shape that is interchangeably mountable on the lower end of the tool shown in FIG. 2.

Moreover, as is shown in FIGS. 2 and 2A, the tool can be converted quickly and easily to form bores having different diameters, depending on the size of post to be installed or other factors. As can be seen, the main vertical pipe 16 of the tool has a detachable lower segment 42 which extends through the central bore in the mandrel member and threadingly engages a coupling 44 on the lower end of the upper pipe segment. Detaching and withdrawing the lower pipe segment 42 permits the mandrel 18 to be interchangeably replaced with mandrels 46 of different sizes or shapes, e.g., mandrels of smaller or larger diameters. To install the second mandrel, the detachable pipe segment is slipped through the central bore of the mandrel and then reattached to the main pipe section; the coupling 44 and a flange 48 on the bottom of the detachable pipe section act as upper and lower stops to hold the mandrel member in place and prevent it from sliding longitudinally along the shaft.

b. Components/Assembly

Figure 3:
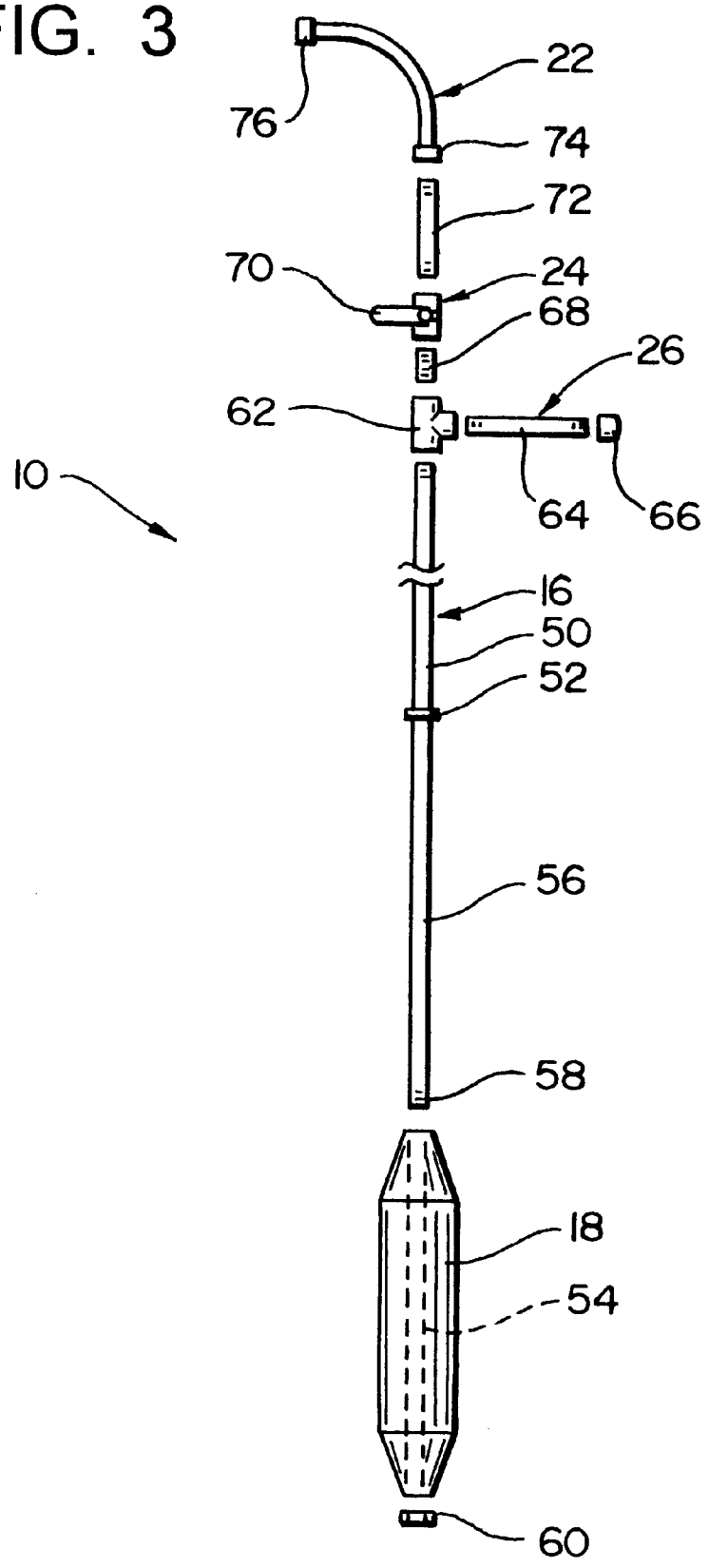
FIG. 3 is an exploded view of the tool of FIGS. 1–2, showing the component parts of the assembly.

The exploded view in FIG. 3 shows the individual components of an exemplary tool assembly in accordance with the present invention. This embodiment differs slightly from that shown in FIGS. 1–2, in that the main pipe extends continuously through the bore of the mandrel member, with a detachable retainer being threaded on the lower end rather than the lower section of the pipe itself being detachable.

Accordingly, the main pipe 16 includes an elongated pipe nipple 50 having a lock ring 52 mounted partway along its length. The mandrel member includes a central bore 54 through which the lower section 56 of the pipe (below lock ring 52) extends in a close-fitting, but sliding engagement. The length of the lower section 56 is such that the threaded lower end 58 of the pipe protrudes just beyond the bottom of the mandrel member, for attachment of a pipe nut 60 which secures the mandrel member to the pipe. In some embodiments a conical metal nozzle may be used in place of or in conjunction with the pipe nut 60 to provide the tool with enhanced penetration and wear characteristics.

The upper end of the long nipple 50, in turn, is threaded into one leg of a pipe tee 62. A comparatively short (e.g., 6") nipple 64 is threaded into the transverse leg of the tee so as to form the handle 26, with a pipe cap 66 being threaded onto the end of the handle.

The ball valve 24 is mounted to the second leg of the tee by a close nipple 68. The ball valve is provided with a control lever 70 which permits convenient manual operation of the valve; as is conventional in such valves, the handle is preferably attached so that the valve is open when the handle is aligned with the direction of flow, and closed when the handle is turned to the transverse position.

Another comparatively short pipe nipple 72 connects the ball valve 24 to one end of the flexible supply hose 22, using a hose coupling 74. The opposite end of the supply hose is provided with a second hose fitting 76 for attachment to the hose from the pressure source (not shown). The flexible supply hose renders the tool more maneuverable and easier to use for a single operator; in a preferred embodiment, the flexible supply hose may be about a foot long, and provided with reinforcement/protection (such as wound wire sheath, for example) for additional strength and durability.

The exemplary embodiment which is shown in FIG. 3 employs ¾" galvanized steel pipe as its main structural material, with an exemplary parts list being as follows:

| PN | PARTS LIST | QTY |
|---|---|---|
| 1 | Supply Hose | 1 |
| 2 | 3/4 × 6 Nipple | 2 |
| 3 | 3/4 Ball Valve | 1 |
| 4 | 3/4 Close Nipple | 1 |
| 5 | 3/4 Tee | 1 |
| 6 | 3/4 Cap | 1 |
| 7 | 3/4 × 48 Nipple | 1 |
| 8 | 3/4 Lock Ring | 1 |
| 9 | 4 Inch Mandrel | 1 |
| 10 | 3/4 Pipe Nut | 1 |

It will be understood, however, that the assembly may be constructed using different materials and a different arrangement of components than the particular example which has been given above. For example, while galvanized steel pipe has many advantages in terms of strength, durability and corrosion resistance, other embodiments may be constructed of other types of metal/plastic pipe or other types of conduit. Similarly, other types of valves may be used in place of the ball valve in some embodiments.

As for the mandrel member, this may also be formed of any suitable material. A heavy grade of plastic, such as an extruded UHWM plastic "log", cut to length, bored, and then lathed to form the tapered ends, is eminently suitable for this purpose in terms of strength and durability; also, the weight of the solid plastic material provides the tool with good balance and handling characteristics. It will be understood, however, that any suitable material may be used to form the mandrel member, such as various metals, plastics or molded resins, for example.

Suitable dimensions for two sizes of interchangeable mandrel members are shown in FIGS. 4A–4B and 5A–5B.

Figure 4A:
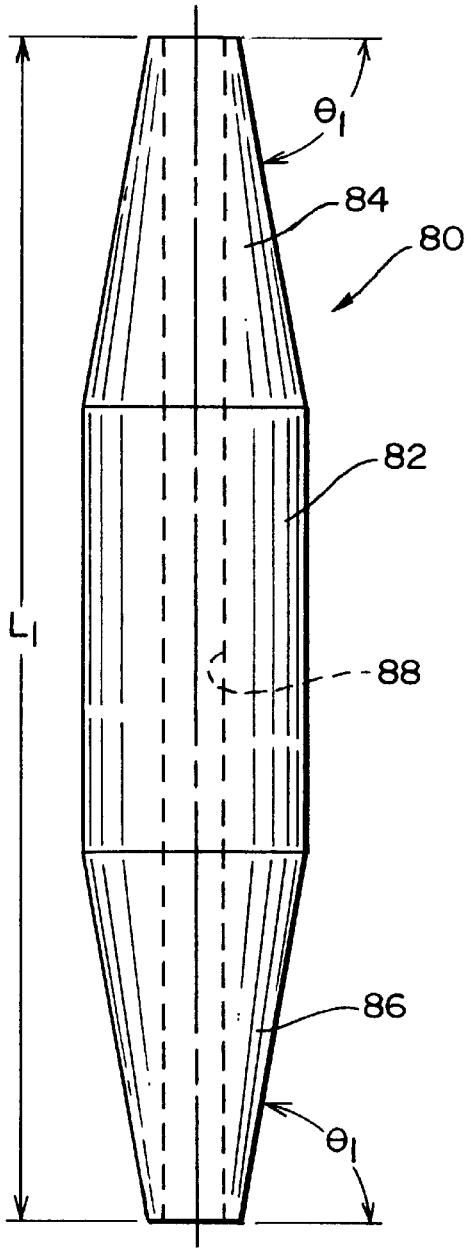
FIGS. 4A and 4B are, respectively, elevational and end views of a first size of mandrel member which is mountable on the lower end of the tool shown in FIGS. 1–3.
Figure 4B:
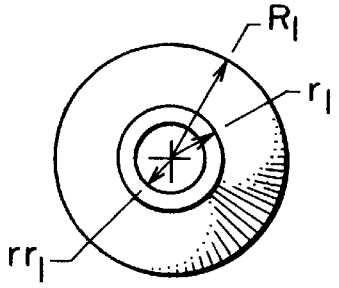

The main body portion 82 of the mandrel 80 shown in FIGS. 4A–4B has a cylindrical radius $R_1$ of about 2.00", and an overall length $L_1$ of about 22.0". The upper and lower tapers 84 and 86 are each formed at an angle $\theta_1$ of about 80°, (i.e., a 10° taper) with the radius $rr_1$ at the tip of the mandrel being about 0792". The radius $rr_1$ of the axial bore 88, in turn, is about 0.542", so as to provide sufficient clearance for the mandrel member to slide onto the end of the lower end of the main pipe, but without creating excessive "slop".

Figure 5A:
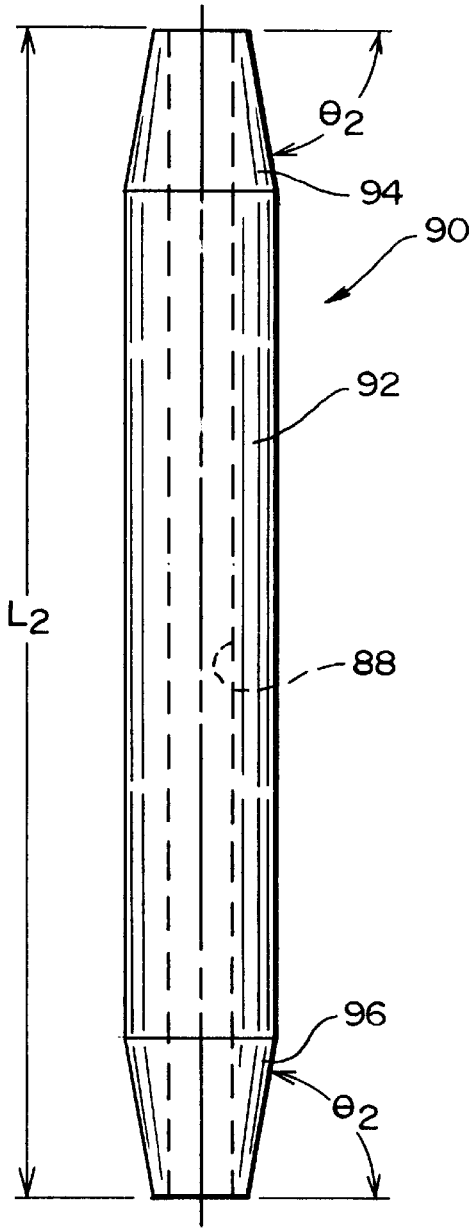
FIGS. 5A and 5B are, respectively, elevational and end views of a second size of mandrel member which is mountable on the tool of FIGS. 1–3.
Figure 5B:
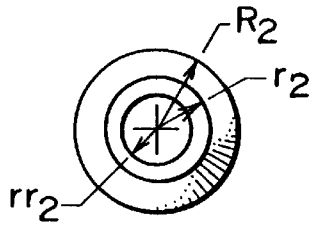

FIGS. 5A–5B, in turn, show the dimensions of a second size mandrel 90 which is mountable to the tool interchangeably with that shown in FIGS. 4A–4B. Exemplary dimensions for this size of mandrel are as follows: radius $R_2$ of main body 92 –1.00; overall length $L_2$ of mandrel 90 –22"; angle $\theta_2$ of upper and lower end tapers 94, 96 –80°; tip diameter $r_2$ –0.613"; diameter $rr_2$ of bore 98 –0.425".

Mandrel members having the dimensions described above have demonstrated excellent performance when used in common soils and when supplied with water pressures in the range described above. It will be understood, however, that mandrel members having other dimensions and/or shapes may be employed in the present invention, including, for example, that which is shown in FIG. 6.

c. Additional Features

Figure 6:
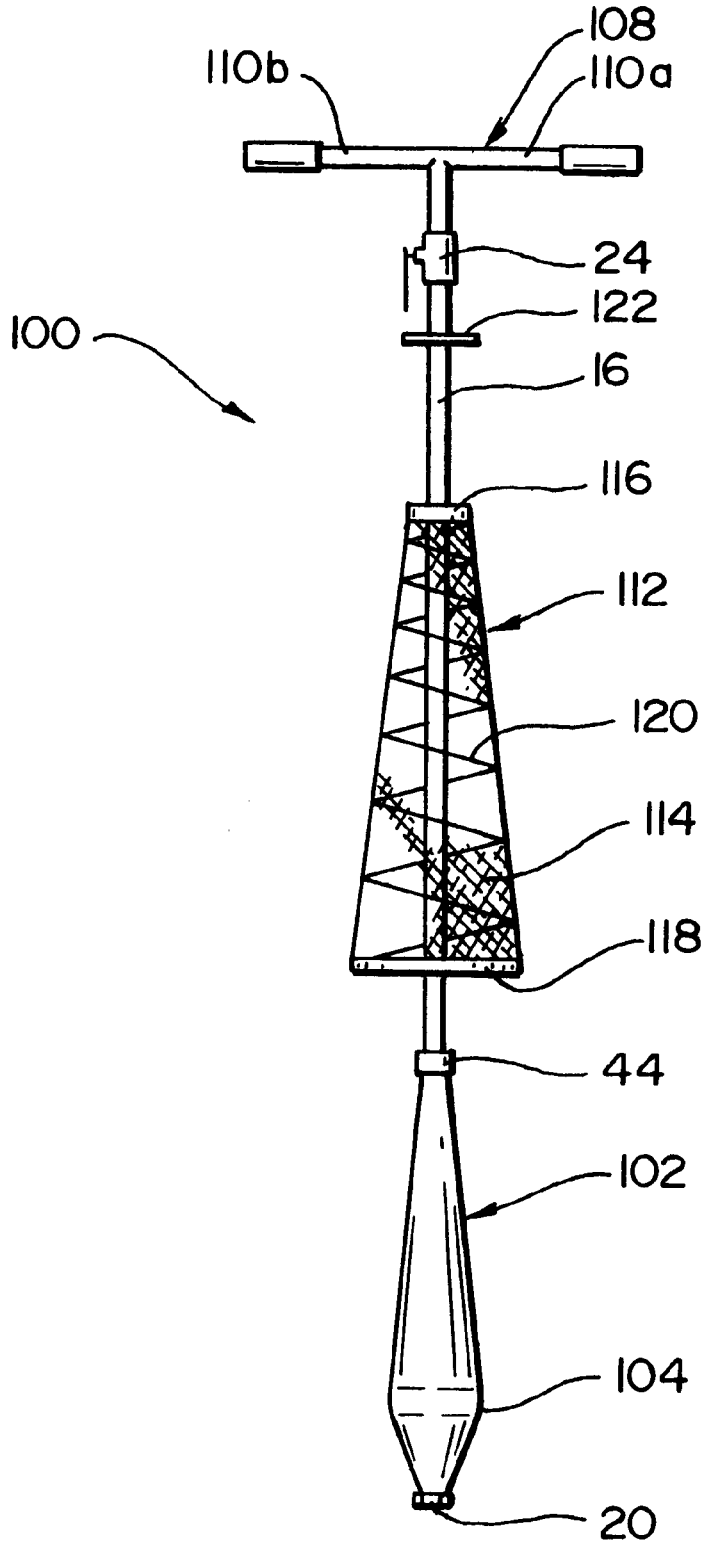
FIG. 6 is an elevational view of a tool in accordance with a second embodiment of the present invention, showing this with a tapered mandrel member on its lower end and a spray-containing skirt which is mounted around the main shaft of the tool.

FIG. 6 shows a tool 100 in accordance with another embodiment of the present invention. As can be seen, this includes a mandrel member 102 which, rather than having a generally cylindrical form as in those described above, has a bulbous, downwardly-pointed head portion 104 at its lower end, and a long, gently tapered portion 106 at its upper end. This form of mandrel may be preferable for use in certain types of soils.

The tool shown in FIG. 6 also includes a "T"-shaped head 108 having first and second handles 110*a*, 110*b*, which enable the operator to exert a strong downward pressure on the device.

Furthermore, the assembly includes an optional skirt-shaped spray shield 112, which serves to protect the operator against water/mud exiting the top of the bore. As can be seen, the shield includes a conical fabric skirt 114, which extends from a small-diameter upper ring 116 which fits closely about the pipe 16, to a larger-diameter bottom ring 118 which is sized to fit over and around the top opening of the hole. A conical spring 120 inside the skirt biases the upper and lower rings apart so as to maintain the conical shape of the shield.

The upper ring 116 is in sliding engagement with pipe 16, so that the spray shield is free to move up and down along the pipe while ring 118 rests on the surface of the ground. Thus, the spray shield can be slid to a lowermost portion in which it substantially surrounds the mandrel member, thereby protecting the operator as boring begins. Then, as the tool penetrates downwardly into the ground, the skirt slides up the pipe while the bottom ring maintains contact with the surface around the opening. A stop ring 122 is mounted around the pipe below ball valve 24, to arrest vertical movement of the shield at this point; as the tool is depressed further into the ground, the spring 120 yields resiliently so that the skirt gradually collapses while maintaining the cover over the hole.

It is to be recognized that various alterations, modifications, and/or additions may be introduced into the constructions and arrangements of parts described above without departing from the spirit or ambit of the present invention.

What is claimed is:

1. A post-hole digging tool, comprising:

an elongate conduit member having an upper end for receiving a flow of water under pressure and a lower end; and an enlarged mandrel member mounted to said lower end of said conduit member, said mandrel member comprising:

an elongate body portion having upper and lower ends and a generally circular cross section;

a generally axial bore formed in said body portion for passage of said flow of water therethrough;

a nozzle opening formed at said lower end of said body portion for discharge of said flow of water therefrom; and a generally conical taper on said lower end of said body portion for accelerating and directing said flow of water into a generally annular passage around said body portion;

so that said flow of water which is discharged from said nozzle opening excavates a bottom of a post-hole bore and flows upwardly through annular passage around said body so as to remove soil material along upwardly-extending sides of said bore.

2. The tool of claim 1, wherein said mandrel member further comprises:

a generally conical taper on said upper end of said body portion for decelerating said flow of water as said flow exits said annular passage and passes upwardly through said post-hole bore.

3. The tool of claim 2, wherein said body portion of said mandrel member comprises:

an elongate cylindrical member having said conical tapers formed on upper and lower ends thereof.

4. The tool of claim 3, wherein said body portion has a diameter in the range from about 2 inches to about 6 inches and said conical taper on said lower end of said body portion has a taper of about 10°.

5. The tool of claim 2, wherein said body portion of said mandrel member comprises:

an elongate tapered member having a bulbous lower end and a gently tapered upper end.

6. The tool of claim 1, wherein said elongate conduit member comprises:

an elongate pipe member for extending vertically through a post-hole bore.

7. The tool of claim 6, further comprising:

means for interchangeably mounting mandrel members of different sizes to said lower end of said elongate conduit member.

8. The tool of claim 7, wherein said means for interchangeably mounting said mandrel members to said conduit member comprises:

a lower end portion of said pipe member for extending through said bore in said body portion of said mandrel member; and a retainer member which is detachably mounted to said lower end portion of said pipe member for retaining said body portion of said mandrel member thereon.

9. The tool of claim 6, further comprising:

a manually operable valve for controlling said flow of water though said pipe member.

10. The tool of claim 6, further comprising:

a laterally extending handle member mounted to said pipe member so as to enable an operator to exert a downward force thereon.

11. The tool of claim 6, further comprising:

a spray shield mounted to said conduit member for protecting an operator from said flow of water passing upwardly through a post-hole bore.

12. The tool of claim 11, wherein said spray shield comprises:

a collapsible skirt assembly for fitting over an upper end of a post-hole bore.

13. The tool of claim 12, wherein said collapsible skirt assembly comprises:

a conical fabric skirt having a narrow upper end which fits tightly around an upper portion of said pipe member and a wide lower end which extends around a lower portion of said pipe member for covering an upper end of a post-hole bore.

14. The tool of claim 1, wherein said body portion of said mandrel member comprises:

a solid body member having a weight selected to balance said tool for vertical orientation in a post-hole bore.

15. The tool of claim 14, wherein said body member is formed of solid UHMW plastic material.

16. A portable post-hole digging tool, comprising:

an elongate pipe member having an upper end for attachment to a flexible hose so as to receive a flow of water under pressure therefrom, and a lower end for extending downwardly into a post-hole bore;

a laterally extending handle member mounted to said pipe member so as to enable an operator to exert a downward force thereon;

a stop ring mounted on said pipe member a spaced distance from said lower end thereof;

an enlarged mandrel member mounted on said lower end of said pipe member, said mandrel member comprising:

an elongate, generally cylindrical body portion formed of substantially solid material and having upper and lower ends and a generally axial bore through which said pipe member extends;

a nozzle opening formed at said lower end of said body portion of said mandrel member for discharge of said flow of water therefrom in a generally axial direction towards a bottom of a post-hole bore for excavation thereof;

a generally conical taper formed on said lower end of said body portion for directing and accelerating said flow of water from said bottom of said post-hole bore upwardly through a generally annular passage around said cylindrical body portion so as to remove soil material along upwardly-extending sides of said bore; and a generally conical taper formed on said upper end of said body portion for decelerating said flow of water as said flow exits aid annular passage and passes upwardly through said post-hole bore; and a retainer member mounted on said lower end of said pipe member so that said mandrel member is retained on said pipe member with said lower end of said body portion in abutment with said retainer member and said upper end of said body portion in abutment with said stop ring which is mounted on said pipe member.

17. The tool of claim 16, wherein said retainer member comprises:

a metal retainer member which fits against said lower end of said body portion of said mandrel member so as to protect said lower end of said body portion from wear due to penetration of soil materials.

18. The tool of claim 16, wherein said retainer member comprises:

a ring member which is mounted to said lower end of said pipe member.

19. The tool of claim 16, wherein said retainer member comprises:

a generally conical nozzle member mounted to said lower end of said pipe member.

20. A hand-held tool for excavating a hole in soil material, said tool comprising:

an elongate conduit member having an upper end for receiving a flow of water under pressure and a lower end; and an enlarged mandrel member mounted to said lower ends of said conduit member, said mandrel member comprising:

an elongate body portion having upper and lower ends and an outer surface for engaging surrounding soil material;

a generally axial bore formed in said body portion for passage of said flow of water therethrough; and a nozzle opening formed at said lower end of said body portion for discharge of said flow of water therefrom, said lower end of said body portion being contoured for engaging said surrounding soil material so that said flow of water is directed outwardly across said lower end of said body portion and upwardly along said outer surface of said body portion;

so that said flow of water which is discharged from said nozzle opening removes soil material from proximate said nozzle opening and flows upwardly along said outer surface of said body portion so as to remove soil material along an upwardly-extending side of said hole.

21. The tool of claim 20, wherein said mandrel member further comprises:

a generally conical taper on said lower end of said body portion for accelerating and directing said flow of water into an annular passage around said body portion.

22. The tool of claim 21, wherein said elongate conduit member comprises:

an elongate pipe member for extending vertically through said hole.

23. The tool of claim 22, further comprising:

a laterally extending handle member mounted to said pipe member so as to enable an operator to exert a downward force thereon.

* * * * *